US005566664A

United States Patent [19]

Todd

[11] Patent Number: 5,566,664

[45] Date of Patent: Oct. 22, 1996

[54] BOW STRING RELEASE WITH ROLLER STRING RETENTION MEMBERS

[76] Inventor: Gary J. Todd, 33551 Giftos, Clinton Township, Mich. 48035

[21] Appl. No.: 433,983

[22] Filed: May 4, 1995

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 4,403,594 | 9/1983 | Todd | 124/35.2 |
| 4,860,720 | 8/1989 | Todd | 124/35.2 |
| 4,926,835 | 5/1990 | Peck | 124/35.2 |
| 5,070,854 | 12/1991 | Peck | 124/35.2 |
| 5,247,921 | 9/1993 | Todd | 124/35.2 |
| 5,359,983 | 11/1994 | Peck | 124/35.2 |
| 5,365,911 | 11/1994 | Todd | 124/35.2 |

*Primary Examiner*—John A. Ricci
*Attorney, Agent, or Firm*—Charles W. Chandler

[57] ABSTRACT

A bow string release includes a trigger-operated mechanism for controlling the motion of a pair of rollers between a string-retaining position and a string-release position. The bowstring is retained in a taut condition in a slot in the body of the release. The rollers are axle-less so that they can slide from the string-retaining position, engaging one another, toward a release position as the taut bow string urges the rollers apart to pass between them.

3 Claims, 1 Drawing Sheet

BOW STRING RELEASE WITH ROLLER STRING RETENTION MEMBERS

BACKGROUND OF THE INVENTION

This invention is related to a bow string release having a slot for receiving the bow string. A pair of rollers retain the bow string in the slot until a release mechanism frees the rollers so the bow string can pass between them.

A class of bow string releases have a body with a slot or a notch for receiving the bow string. A pair of sears are mounted in a channel that is transverse to the slot. Typically, the sears comprise a pair of balls that are moveable in the channel toward and away from the notch. When the balls are adjacent one another, they restrain the bow string. When a trigger mechanism is actuated, the balls are released so that they can separate to pass the bow string between them.

Examples of such prior art may be found in U.S. Pat. No. 5,365,911 which issued Nov. 22, 1994 for "Trigger-Operated Bow String Release Device Having an Adjustable Pre-Travel"; U.S. Pat. No. 4,860,720 which was issued Aug. 29, 1989 for "Bow String Release Device"; and U.S. Pat. No. 4,403,594 which was issued Sep. 13, 1983 for "Bow String Release", all to Gary J. Todd; and U.S. Pat. No. 4,926,835 which was issued May 22, 1990 for "Ball Bearing Type Bow String Release" to Paul L. Peck.

Another type of release employs a pair of elongated cylindrical members that slide along their axis into and out of the string retaining notch.. An example of such prior art may be found in U.S. Pat. No. 5,070,854 which was issued Dec. 10, 1991 for "Bow String Release" to Paul L. Peck.

U.S. Pat. No. 5,247,921 which was issued Sep. 28, 1993 for "Archery Bowstring Release Device" to Gary J. Todd illustrates a bow string release having rollers carried on the outer ends of a pair of pivotally mounted calipers to control the release of the bow string.

SUMMARY OF THE INVENTION

The broad purpose of the present invention is to provide an improved bow string release in which a pair of axle-less rollers are supported in channels that intersects a string retention slot in the body of the release. When the rollers are adjacent one another, they prevent release of the bow string. When the rollers are permitted to separate by manipulation of a trigger-operated release mechanism, the bow string passes between the rollers, engaging the cylindrical surfaces of the rollers, causing them to reciprocate in their respective channels.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
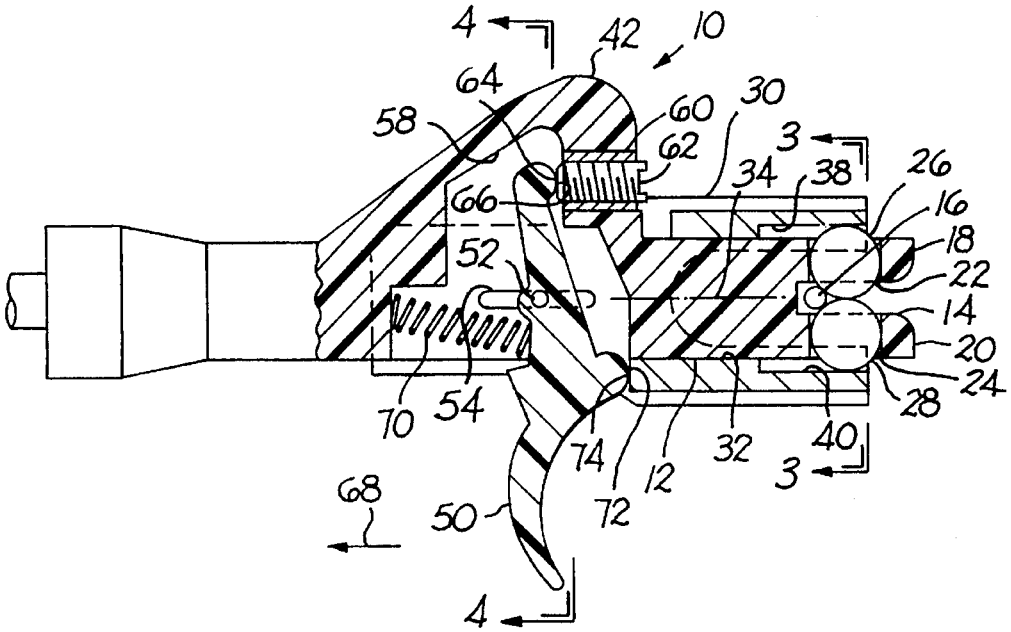
FIG. 1 is a longitudinal sectional view taken through a bow string release embodying the invention.

FIG. 1 shows a bow string release 10 that includes an elongated string engaging body 12 formed as a one piece plastic molded member. The forward end of body 12 has an outer cylindrical surface and a notch or slot 14 adapted to receive bow string 16. The slot includes two spaced parallel arms 18 and 20 having aligned transverse channels 22 and 24. Each channel has a rectangular cross section with parallel side surfaces.

The channels floatably accommodate two axle-less roller-shaped string retention rollers 26 and 28. The two rollers are freely moveable in their respective channels between a string-retention position illustrated in FIG. 1 in which the cylindrical surfaces of the two rollers engage one another, and a string-release position illustrated in FIG. 2, in which the two rollers am spaced a distance sufficient to permit the bow string to pass between them from the rear of the slot. The two rollers are rotatable about parallel axis and each has an outer cylindrical surface. The rollers preferably have an identical cylindrical diameter and thickness, and each has flat parallel side surfaces.

A roller holding sleeve 30 has a bore 32 slidably receiving body 12 for movement along an axis 34 which coincides with the longitudinal axis of body 12. Axis 34 also coincides with the path of motion of the bow string as it is received into notch 14.

Sleeve 30 is a one piece cast metal member that surrounds the body. Referring to FIG. 1, the forward end 36 of the sleeve has a 3air of internal cut-out portions 38 and 40 which enlarge the bore so that the sleeve engages the cylindrical surfaces of the two rollers when they are in their string-retention position, preventing the two rollers from moving away from one another in their respective channels.

Figure 2:
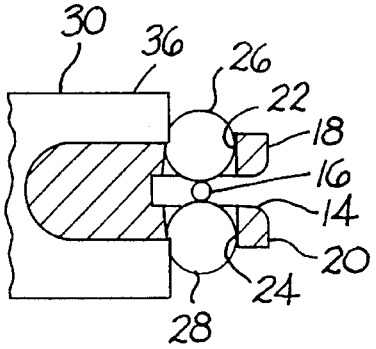
FIG. 2 is a fragmentary view of the rollers in their release position.

Referring to FIG. 2, the sleeve can be moved away from the roller retention channels to a position permitting the two rollers to separate sufficiently to pass the bow string between them. In this position, the distance between the bore and the channel side opposite the sleeve is less than the diameter of the rollers to prevent them from dropping out of their respective channels.

Body 12 has an integral, external protrusion 42 that extends through a central, longitudinal cut-away slot in sleeve 30. Protrusion 42 forms a: resting surface for the archer's thumb when using the release for pulling the bow string to an arrow launching position.

Figure 4:
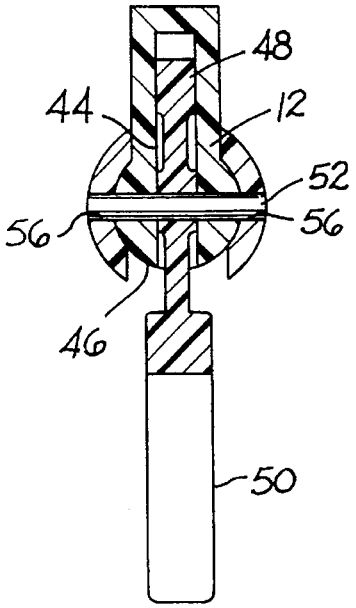
FIG. 4 is a fragmentary enlarged sectional view taken along lines 4—4 of FIG. 1.
Figure 3:
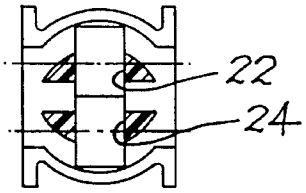
FIG. 3 is a transverse sectional view taken along lines 3—3 of FIG. 1.

Referring to FIG. 4, the body has a relatively narrow internal cavity 44 to accommodate a lever 48. Trigger 50 forms an integral lower end of the lever and extends out of the cavity. Pivot pin 52 swingably connects the lever to the head.

Pin 52 is mounted in two aligned linear slots 54 in the side walls of body 12, only one of which is visible in FIG. 1. Pin 52 moves linearly along the two slots in the body so sleeve 30 slides along the body. Pin 52 is preferably a hollow, C-shaped, roll pin, having its ends anchored on opposite sides of the sleeve. The roll pin serves as a bearing for lever 48.

The body has an internal cavity 58 located within protrusion 42. An annular brass insert 60 is embedded in the forward end of the protrusion. The insert is internally threaded to form a mounting surface for set screw 62. The inner end 64 of the set screw forms an abutment surface for a curved end surface 66 on the upper end of the lever.

When trigger 50 is pulled rearwardly in the direction of arrow 68, the lever forms a forwardly acting force on set screw 62. The lever swings around pin 52 while the pin moves rearwardly along slots 54 to pull the sleeve rearwardly, thereby freeing rollers 26 and 28 for lateral movement in their channels to release the bow string. When finger pressure on trigger 50 is removed, a coil spring 70 in cavity 58 biases the lever and the sleeve forward to the retention position illustrated in FIG. 1. A stop surface 72 on the lever engages shoulder 74 on the sleeve to define the position of the forward end of the sleeve. The relationship between the sleeve and roller elements 26 and 28 can be varied by adjusting the position of set screw 62.

When set screw 62 is turned to move its inner end 64 to the left as viewed in FIG. 1, the lever pivots slightly in a counter clockwise direction, thereby causing stop surface 72 to exert a rightwardly acting force on shoulder 74. The sleeve is moved a slight distance to the right relative to the rollers. Turning the set screw in the opposite direction adjusts the position of the sleeve toward the left, reducing the trigger travel necessary to release the bowstring.

Set screw 62 constitutes an adjustable abutment structure that can be turned to vary the distance the trigger has to be pulled until the bias of a taut bow string, separate the two rollers. The bow string is trapped in the slot by the two rollers until they are released by the sleeve. The turning axis of screw 62 is preferably parallel to the sleeve movement axis 34.

Having described my invention, I claim:

1. A bow string release mechanism comprising:

a string-engaging body (12) having a string-reception slot (14) therein, forming two spaced arms (18 and 20), said slot being disposed in a plane that defines the movement plane of the bowstring;

a roller guide channel (22 or 24) extending through each arm in a direction transverse to the slot plane, each guide channel having an axis, said channels being axially aligned;

a cylindrical axle-less roller floatably mounted in each guide channel for translational movement along the channel axis;

each roller having a central axis, a cylindrical side surface centered on said central axis, and two end surfaces;

said rollers being arranged in their respective channels so that the roller axes are parallel to each other and to the engaged section of the bowstring, whereby the bowstring exerts an expanding force on opposed cylindrical side surfaces of the rollers; and a roller-retainer sleeve (30) slidably encircling said string-engaging body for movement between a first position forcing the two rollers into surface engagement with each other, and a second position displaced from the channel axes, whereby said rollers are separated to release the bowstring.

2. The bow string release mechanism as defined in claim 1, wherein the diameter of each roller is greater than the axial length of each roller.

3. The bow string release mechanism as defined in claim 2, wherein the cylindrical side surface of each roller intersects the associated roller end surfaces to form two annual shoulders; said roller-retainer sleeve having arcuate cylindrical surfaces engageable with the annular shoulders son the rollers to retain the rollers in surface engagement with each other.

* * * * *